US006298508B1

(12) United States Patent
McCloskey

(10) Patent No.: US 6,298,508 B1
(45) Date of Patent: Oct. 9, 2001

(54) KNEEL CUSHIONS

(76) Inventor: George McCloskey, P.O. Box 243, Pipersville, PA (US) 18947

( * ) Notice: Subject to any disclaimer, the term of this patent is extended or adjusted under 35 U.S.C. 154(b) by 0 days.

(21) Appl. No.: 09/512,208

(22) Filed: Feb. 24, 2000

(51) Int. Cl.[7] ..... A47C 9/00
(52) U.S. Cl. ..... 5/632; 5/648; 5/653
(58) Field of Search ..... 5/632, 648, 652, 5/653, 655.9; 297/423.11, 338, 195.11

(56) References Cited

U.S. PATENT DOCUMENTS 3,863,978 * 2/1975 Gillings ..... 297/195.11
5,865,507 * 2/1999 Earl ..... 297/423.11
5,882,081 * 3/1999 Earl ..... 297/195.11

* cited by examiner

*Primary Examiner*—Lynne H. Browne
*Assistant Examiner*—Fredrick Conley
(74) *Attorney, Agent, or Firm*—Gregory J. Gore

(57) ABSTRACT

A kneel-type chair is provided by a pair of interconnected cushions and provides a frameless device that is lightweight, portable and rugged. A bottom solid wedge base composed of a firm foam includes a cut-out leg groove lined with three layers of varying density foam that receives the knees of the occupant. The bottom cushion is angled downward in the front so that the occupant's knees are supported at the lowest point on the cushion. Upwardly extending portions located at the sides of the bottom cushion provide a lateral boundary to the occupant's lower legs. An upper, smaller wedge support cushion is positioned behind the occupant's knee joints extending to and supporting the occupant's buttocks. The upper cushion is releasably attached to the upwardly extending portions of the lower cushion by means of hook-and-loop-type fasteners. The material of both the upper and lower cushions is preferably molded polyethylene foam.

5 Claims, 3 Drawing Sheets

KNEEL CUSHIONS

FIELD OF THE INVENTION

The present invention relates to cushion furniture, more specifically it relates to a type of furniture to support the occupant in a combined kneeling and sitting position.

BACKGROUND OF THE INVENTION AND PRIOR ART

For a bad lower back strain or a sensitive lower spine, it may become painful to remain seated for quite some time. This is especially true when working with computers. The long hours accumulated over the years may have added to this aggravation so more hours sitting may worsen this condition. However, we become so dependent upon our routine and the work must go on. To relieve this strain, we relieve the total weight-hours of sitting.

There is therefore a need to provide a light-weight and convenient article in which the occupant can optimally work in a kneeling position to take the body weight pressures off the spine. This is especially true in the most commonly experienced position, working before a computer stand, desk or table. There should also be breaks from this extensive kneeling position by some sitting or better yet, standing and working with a computer stand.

The closest patent prior art of which the applicant is aware includes the following U.S. Patents: U.S. Pat. No. 4,772,071, issued to Richards, entitled "Knee Pads"; U.S. Pat. No. 4,603,444, issued to Suits, entitled "Convertible Furniture Apparatus"; U.S. Pat. No. 4,171,549, issued to Morrell et al., entitled "Cushion Ensemble And Method Of Arranging Cushions To Provide The Same"; Patent No. 4,518,203, issued to White, entitled "Convertible Cushion Furniture"; and U.S. Pat. No. 3,742,526, issued to Lillard, entitled "Combination Chair And Chaise Lounge". However, none of these examples provide the simplicity and economical use of an item of furniture constructed only of cushions which provides the user with a comfortable kneeling/sitting position. In addition, the present invention provides a chair which is also both light-weight, portable, and rugged. There is therefore a need in the art for a device which meets these requirements.

SUMMARY OF THE INVENTION

In order to meet the objectives described above, the present invention, a two-piece cushion article of furniture, has been devised which supports the occupant in a combined kneeling and sitting position. It is particularly suitable for people who spend a great deal of time before a computer and for those who have weak backs, but strong or normal knees. It also affords a comfortable computer working position and a pleasant change in the work environment.

The cushions of the present invention are specially constructed in order to support specific parts of the occupant's body. A bottom solid wedge base composed of firm spongy foam includes a cut-out leg groove lined with 3 layers of varying foam density. These layers are covered with a cloth which is attached to the base by hook and loop-type fastening means, such as Velcro®-type straps. A person kneels into this cut-out for a knee-shin-ankle body weight support on this composite cushion and sinks 1" to 2" into this groove depending upon body weight. The feet dangle over the higher end (back) towards the floor and are higher than the lower knees (front).

The upper, but smaller wedge support, is to support more body weight by being placed in the back of the knee joints extending beyond the buttocks. Thus, the back of the upper legs and the buttocks support the remaining body weight. This upper wedge is held in place from sliding back by being pinched in place between the upper and lower legs when kneeling. It may also be held in place by Velcro®-type straps connecting the upper and lower wedge cushions. With the large sitting angle and low kneeling angle provided by the invention, most of the body weight is transferred from the base of the spine to the front of the legs, knees and back of the upper legs and some of the buttocks, thus, relieving most of the pressure from the tip of the spine and the lower back. This allows one to work at a table, arms level with the chest, such as operating a computer keyboard.

More specifically, the Applicant has devised a cushion kneeler for supporting a human body in a combined kneeling and sitting position comprising two separable cushions. The lower cushion is wedged shaped, slopping downward at the front, said lower base cushion having a bottom side resting on a support surface. The upper cushion is also wedged shaped, having the top and bottom sides convergent at the front. Upwardly extending portions are located at the sides of said lower cushion, said side extensions including first attachment means located along a top surface thereof; and a second attachment means cooperative with said first attachment means, said second attachment means located along the sides of a bottom surface of said upper cushion whereby in use the upper and lower cushions are attached and said upper cushion is located behind and supporting the buttocks of the body while the lower cushion supports the knees and lower legs of the body. The first and second attachment means are hook and loop-type fasteners in a plurality of layers of cushion material, each of different compressibility, varies from hard to soft in the direction of the body of the user. The layering of a cushion material of varying compressibility is also applied to the upper cushion.

It is therefore the main object of the present invention to create a cushion chair which is light-weight and portable and which supports a human body in a way to reduce stress on the spine. It is a further object of the present invention to create a cushion chair which is durable and comfortable. The present invention could be the most comfortable computer working position to date for those that have weak backs but strong or normal knees. It also affords a comfortable computer working position and evan a pleasant change for healthy people without back strain. Further advantages of the present invention will become readily apparent to those of skill in the art from the following drawings and description of the preferred embodiment.

DESCRIPTION OF THE PREFERRED EMBODIMENT

Figure 1:
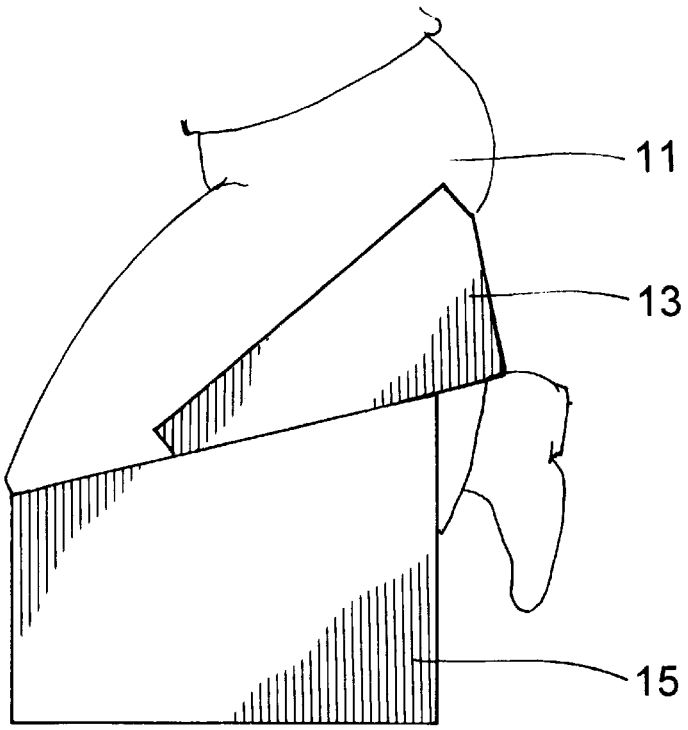
FIG. 1 is a right side view of the present invention shown in use.

Referring now to FIG. 1, a seated occupant 11 shown using the seating cushions of the present invention which comprises upper cushion 13 and lower base cushion 15. Upper cushion 13 is wedge shaped and transmits the weight of the occupant from beneath the buttocks and behind the upper leg transmitting it to the back of the lower leg and to the raised side portion of the lower cushion. The lower cushion 15 supports all the weight of the occupant and when properly positioned extends from below the occupant's knee across substantially the entire length of the lower leg or shin. The angularity of the upper and lower cushions positions the occupant so that the forces of gravity are distributed more to the knees thereby relieving oppressive forces against the spine.

Figure 2:
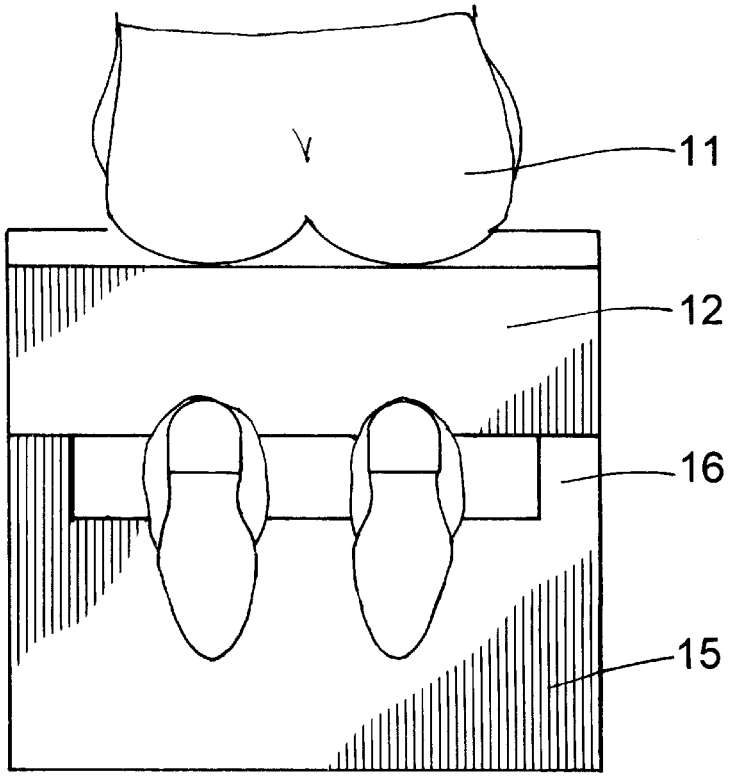
FIG. 2 is a rear view taken from FIG. 1.

Referring now to FIG. 2, a rearview of the occupant is shown being properly positioned on the cushions of the present invention. As shown in this figure upper cushion 13 is partially supported at the sides by side extensions 16 of lower base cushion 15 therefore not all of the forces are transmitted from the thigh area of the occupant transmitted to the back of legs. Upper cushion 13 is held in position and trapped against the occupant's bent leg and also by attachment means between the two parts which are more clearly shown with regard to the FIG. 3.

Figure 3:
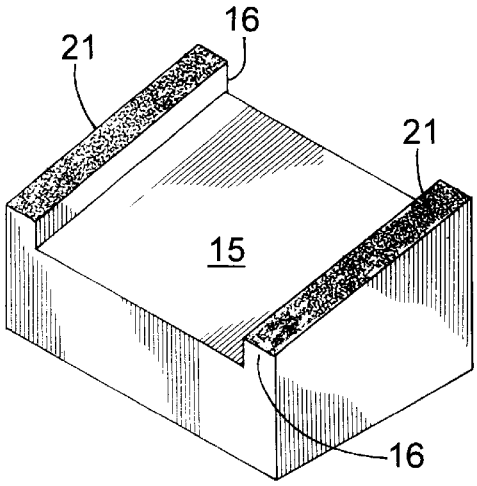
FIG. 3 is a top, front right perspective view of the lower base cushion of the present invention.

Referring now to FIG. 3, the lower base cushion 15 shown in isolation is clearly seen from this view the cushion tapers downwardly toward the front and further includes Velcro®-type hook and loop fastener strips 21 located on top of the upper side extensions 16. The fastener strips 21 coincide with compatible strips at the base of the upper cushion as will be more clearly described.

Figure 4:
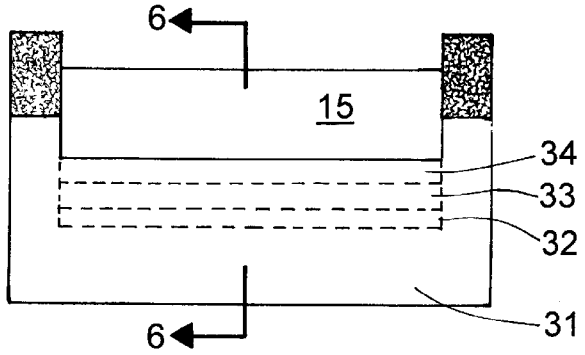
FIG. 4 is a front view of the present invention with the different layers of foam cushioning shown in dotted lines.

Referring now to FIG. 4, an important aspect of the present invention is the utilization of multiple layers of cushioning materials of varying density, shown in phantom in this figure as elements 32, 33, and 34, additional, yet minute cushioning is provided by the base 31. This provides both comfort and weight distribution of the occupant against the lower cushion. For example, it permits the bottom-most layer of cushioning material 31 to be more rigid so that it does not deform, but holds its shape against the full weight of the occupant.

Figure 5:
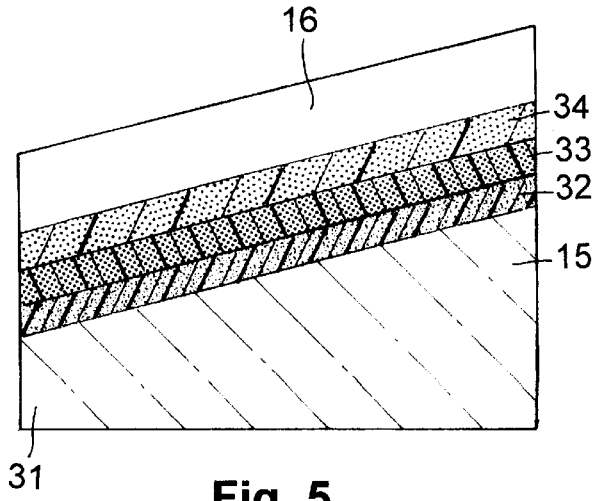
FIG. 5 is a side sectional view taken from FIG. 4 as shown in that figure.

Referring now to FIG. 5, a side sectional view taken from FIG. 4 shows the use of four different materials of varying density. The base layer 31 is the most rigid and may be composed, for example, of molded polyethylene foam. The preferred embodiment includes a top layer 34 of soft 1 inch polyethylene foam and second and third layers of 1½ inch depth of a more dense foam 33 and 32 and the base cushion 31 being the most rigid foam. The material of the base is also a part of the side extensions 16 so that the side extensions are rigid enough to help support the upper cushion retained in position by use of hook and loop fastening means 21 shown in FIGS. 3 and 4. The top of the base provides for comfortable lateral movement of the knees, limited by the upward extending side extensions.

Thus, affixed to the top of the base cushion, there are a multiplicity of cushion layers of varying compressibility from hard to soft in the upper direction of contact with the occupant. This compressibility provides a unique comfort and support to the knees and occupant's legs which rest directly on the lower cushion base.

Figure 6:
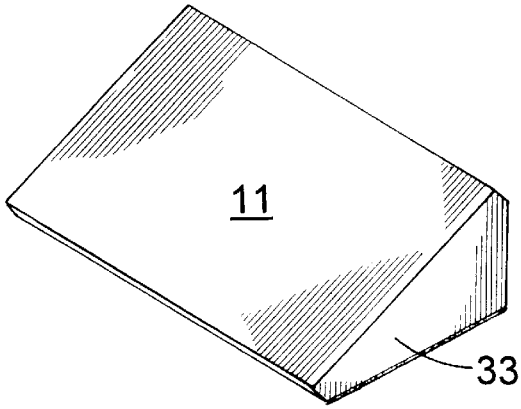
FIG. 6 a top, right front perspective view of the upper cushion element of the present invention.
Figure 7:
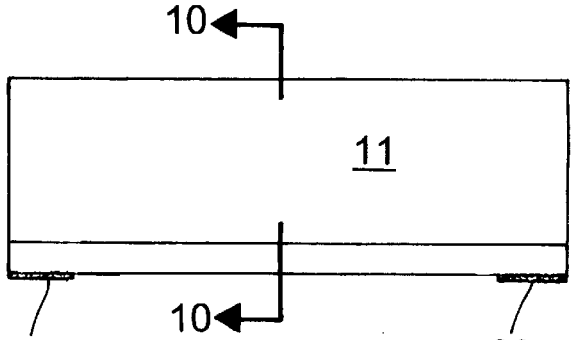
FIG. 7 is a front view of the upper cushion element of the present invention.
Figure 8:
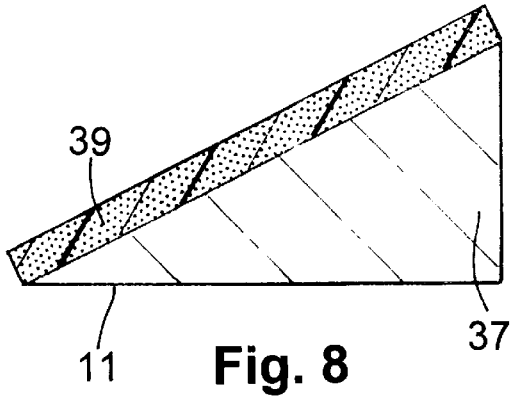
FIG. 8 is a side sectional view taken from FIG. 7 as shown in that figure.

Referring now to FIGS. 6–8, various views of the wedge-shaped upper cushion 11 are depicted. Like the lower, base cushion, the upper cushion is composed of a molded polyethylene with a layer of medium density foam across the top. The upper cushion includes hook and loop fastening strips 33 which mate with compatible hook and loop-type fastening means on the top of the side extensions of the lower cushion to assist in holding the upper cushion in place. Referring to FIG. 8, a fairly rigid bottom portion 37 of the upper cushion is covered with a medium density foam top portion 39 directly contacts the back of the occupant's upper leg, similar to the case of the lower cushion.

Thus, the object of the present invention is to provide a portable, durable kneel-type cushion which is economic to manufacture have been achieved. Also, it will be readily apparent to those in skill in the art from the foregoing description of the preferred embodiment that there may be many variations and changes in the dimensions and the materials used without departing from the spirit and scope of the invention as disclosed. For example, the upper and lower cushion parts may be composed of different materials which achieve the same desirable characteristics of molded polyethylene and may include other structures, such as cloth covers and the like for added comfort and aesthetic purposes. However, the scope of the invention should be determined only by the following claims and their legal equivalents.

What is claimed is:

1. A cushion kneeler for supporting a human body in a combined kneeling and sitting position, comprising;

an ensemble consisting only of two separable cushions;

a lower base cushion being wedge shaped and sloping downward at the front, said lower cushion having a bottom side resting on a support surface and a top surface for receiving leg portions of the human body below the knee;

an upper cushion being wedge shaped and having top and bottom surfaces vertically convergent toward the front;

side portions of said lower cushion extending upwardly from said top surface, said side portions including first attachment means located along a top surface thereof, and second attachment means cooperative with said first attachment means, said second attachment means affixed along the sides of a bottom surface of said upper cushion whereby the upper and lower cushions are attached and said upper cushion is located behind and supports the upper portions of the legs and buttocks of the body.

2. The kneeler of claim 1, wherein said first and second attachment means are hook-and-loop-type fasteners.

3. The kneeler of claim 2, wherein said lower cushion comprises a plurality of layers of cushion material each of different compressibility and varying from hard to soft in the direction of the body of the user.

4. The kneeler of claim 2, wherein said upper cushion comprises a plurality of layers of cushion material each of different compressibility and varying from hard to soft in the direction of the body of the user.

5. The kneeler of claim 2, wherein said material is molded polyethylene foam.

* * * * *